US007131916B2

(12) United States Patent
Griffin

(10) Patent No.: US 7,131,916 B2
(45) Date of Patent: Nov. 7, 2006

(54) BASEBALL SWING TRAINER

(76) Inventor: Thomas Griffin, R.D. #2 Box 202, Olyphant, PA (US) 18447

( * ) Notice: Subject to any disclaimer, the term of this patent is extended or adjusted under 35 U.S.C. 154(b) by 170 days.

(21) Appl. No.: 10/905,213

(22) Filed: Dec. 21, 2004

(65) Prior Publication Data

US 2006/0135292 A1 Jun. 22, 2006

(51) Int. Cl.
*A63B 69/00* (2006.01)
*A63B 71/00* (2006.01)

(52) U.S. Cl. ..... 473/417; 473/451; 473/423

(58) Field of Classification Search ..... 473/417, 473/415, 416, 418, 419, 138–149, 422–432, 473/451, 453; 273/331–335
See application file for complete search history.

(56) References Cited

U.S. PATENT DOCUMENTS 1,907,412 A * 5/1933 Zimmer ..... 473/144
2,247,072 A * 6/1941 Stow ..... 473/426
2,472,065 A * 6/1949 Cottingham ..... 473/229
3,086,775 A * 4/1963 Albert ..... 473/428
3,942,794 A * 3/1976 Gowins ..... 473/427
5,156,402 A * 10/1992 Hart ..... 473/229
5,683,315 A * 11/1997 Ring ..... 473/429
5,762,562 A * 6/1998 Tiedge ..... 473/143
5,924,930 A * 7/1999 Stewart ..... 473/29
6,290,618 B1 * 9/2001 Ring ..... 473/429
6,296,582 B1 10/2001 Minniear
6,688,994 B1 * 2/2004 Matulek et al. ..... 473/429
6,790,150 B1 9/2004 Moss et al.

* cited by examiner

*Primary Examiner*—Eugene Kim
*Assistant Examiner*—M. Chambers
(74) *Attorney, Agent, or Firm*—Mitchell A. Smolow

(57) ABSTRACT

The present invention relates to a baseball swing trainer. In a first embodiment, a ball is pivotally attached to a vertical arm which is slidably attached to an oblique arm, the oblique arm is attached to a horizontal arm which is attached to a support structure; the vertical arm is contained within a first and second guide arm; a stopping member is attached to a first end of the oblique arm and a stopping bar is attached to a second end of the oblique arm such that when the ball is struck, the ball pivots on the vertical arm as the vertical arm slides up the oblique arm, striking the stopping bar and thereafter sliding back down the oblique arm to return to its starting position cradled within the stopping member. The travel path of the ball provides instantaneous feedback as to the quality of the swing.

24 Claims, 5 Drawing Sheets

BASEBALL SWING TRAINER

FIELD OF THE INVENTION

This invention relates generally to athletic training devices, and in particular, to baseball swing trainers.

BACKGROUND OF THE INVENTION

Baseball has been referred to as America's Pastime. For over one hundred years its popularity as both a spectator event and recreational activity has not diminished. Nearly every community has youth leagues where children as young as five years old participate in organized baseball games.

One of the most difficult skills for a young player to learn is to swing the baseball bat level. Indeed, players of all ages, including professional baseball players, continually practice their swing. A level swing provides optimum contact with the ball, produces the most power and, hence, increases the probability of achieving a "base hit".

One key factor used in producing a level baseball swing is to develop what is commonly called "muscle memory" of a proper swing. In essence, repeatedly executing a level swing allows the utilized muscle groups to "remember" what a level swing feels like so that proper execution becomes automatic. Swing training devices, therefore, are designed to allow immediate feedback to the hitter to consistently and repeatedly produce the desired level swing.

Throughout the years many attempts have been made to develop a baseball swing trainer or warm up device which is uncomplicated in structure, economic to produce, adjustable to different size hitters, and allows for automatic return of the baseball to a starting position.

These devices have included various methods of suspending a ball from a rope mounted to a horizontal support member; attaching a ball to a rigid member; or combinations of the two, such as a suspending a rope with a portion of the rope passing through a tube positioned immediately above the ball. The ideal swing training device would also cause the ball when struck with a level swing to consistently take a smooth fight path that simulates the natural motion of a well struck pitched ball.

Unfortunately, the ideal swing trainer has not yet been achieved. Known ball striking devices have either failed to duplicate the normal striking position of a well struck pitched ball, failed to provide a realistic feel and flight of a well struck pitched ball, are overly complex, or are too expensive to manufacture to allow purchase for young ball players. Accordingly, there is still a continuing need for improved baseball swing trainers. The present invention fulfills this need, and further provides related advantages.

BRIEF SUMMARY OF THE INVENTION

The present invention relates to a baseball swing trainer. In a first embodiment, a ball is pivotally attached to a vertical arm which is slidably attached to an oblique arm. The oblique arm is attached to a horizontal arm which is attached to a support structure. The vertical arm is contained within a first and second guide arm. Attached to a first end of the oblique arm is a stopping member and attached to a second end of the oblique arm is a stopping bar such that when the ball is struck, the ball pivots on the vertical arm as the vertical arm slides up the oblique arm, striking the stopping bar and thereafter sliding back down the oblique arm to return to its starting position cradled within the stopping member.

In a second embodiment of the present invention, a method for training a level baseball swing comprises the steps of adjusting a ball to a predetermined swing height; swinging a bat to strike the ball; and watching the travel path of the struck ball to gauge swing effectiveness, wherein the ball is pivotally attached to a vertical arm which is slidably attached to an oblique arm, the oblique arm is attached to a horizontal arm which is attached to a support structure; the vertical arm is contained within a first and second guide arm; a stopping member is attached to a first end of the oblique arm and a stopping bar is attached to a second end of the oblique arm such that when the ball is struck, the ball pivots on the vertical arm as the vertical arm slides up the oblique arm, striking the stopping bar and thereafter sliding back down the oblique arm to return to its starting position cradled within the stopping member.

One advantage of the present invention is that the pivoting movement of the ball as the vertical bar slides along the oblique bar closely mimics the flight path of a well struck ball allowing for immediate feedback of swing effectiveness.

Another advantage of the present invention is that the non-complex design allows for economical production costs, thereby making the swing trainer affordable to young players.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

Figure 1:
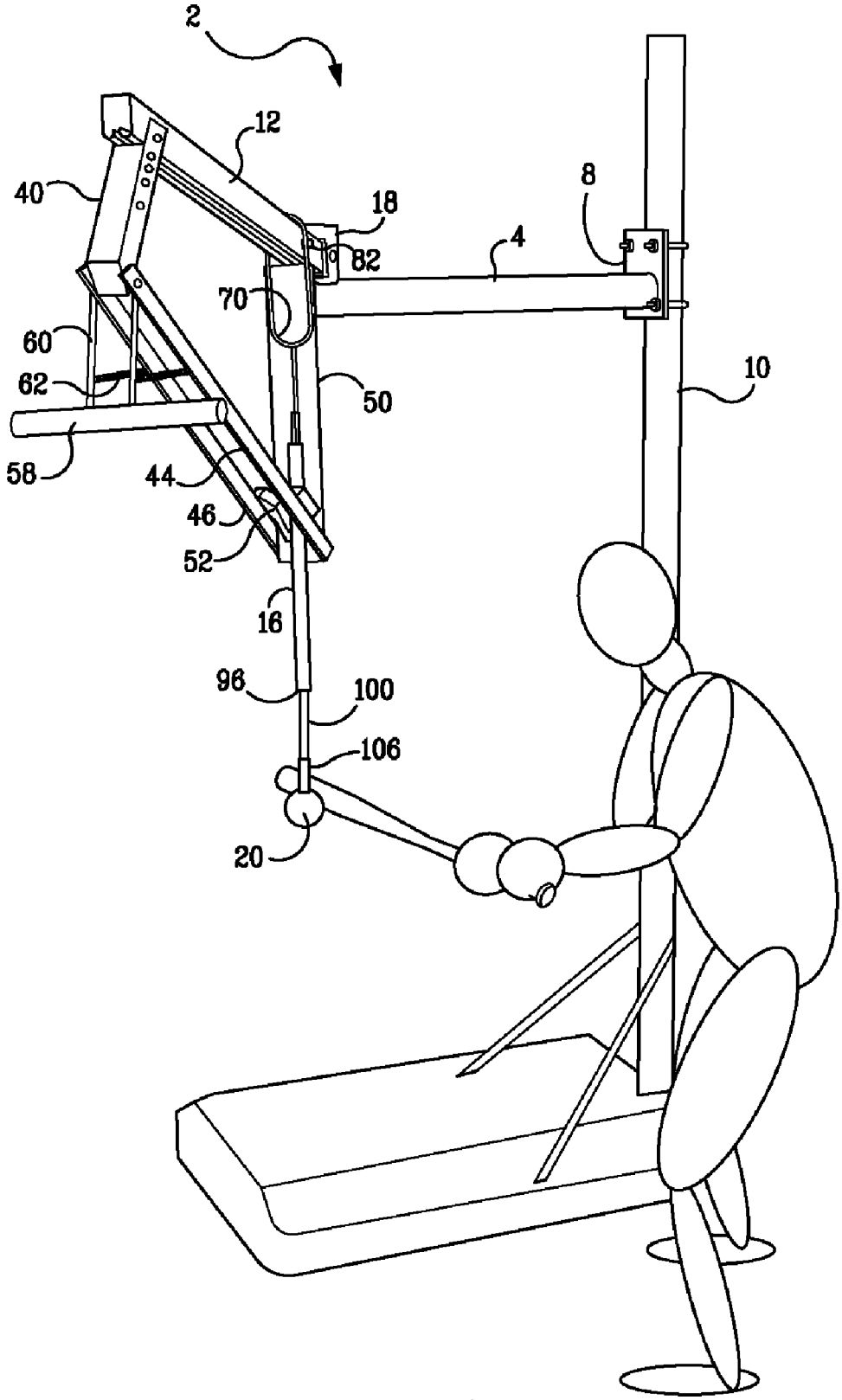
FIG. 1 is an oblique view of the baseball swing trainer of the present invention.
Figure 2:
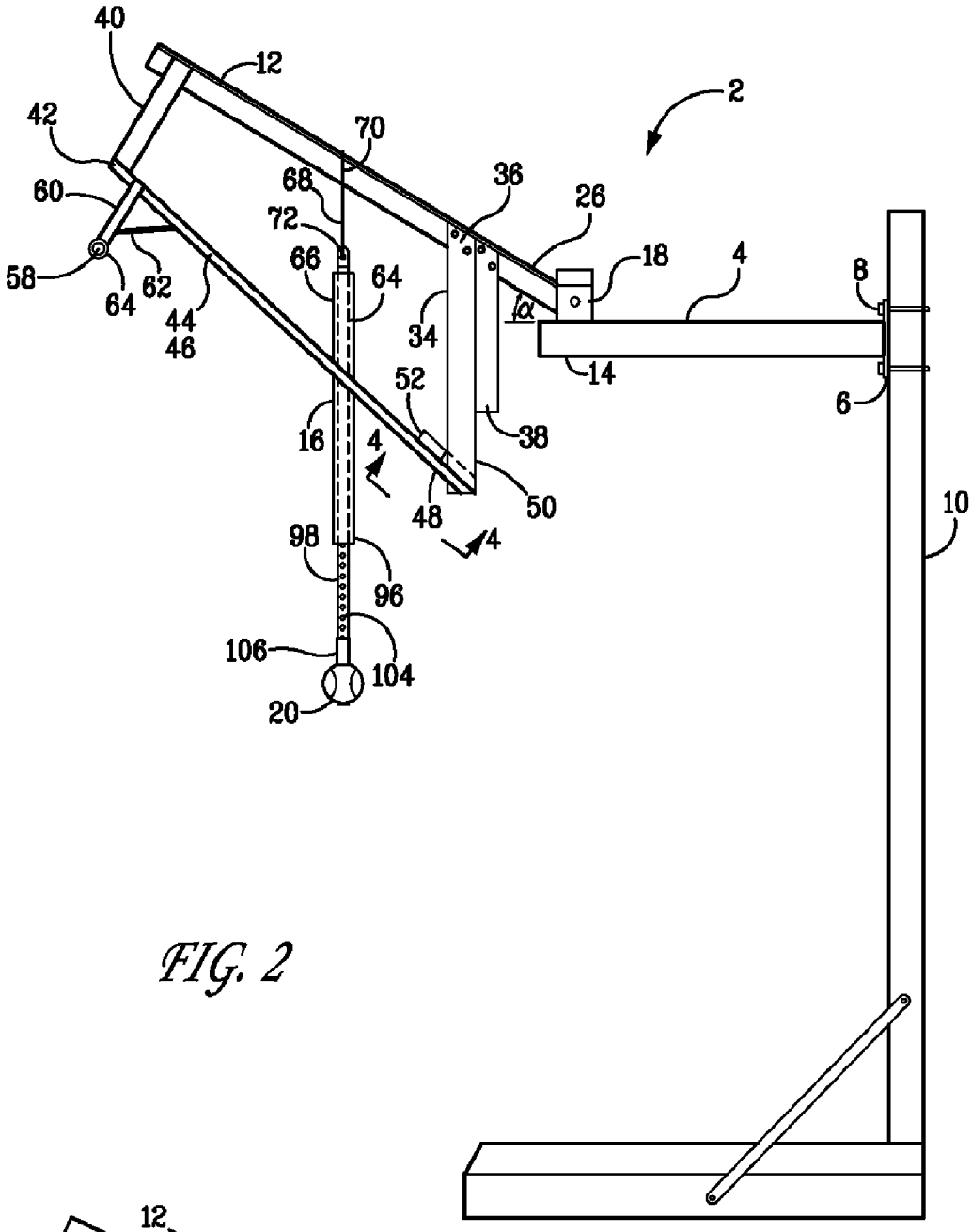
FIG. 2 is a side view of the baseball swing trainer.

Referring now to the figures, in accordance with a preferred embodiment, there is shown in FIGS. 1 and 2 the baseball swing trainer 2 of the present invention. Horizontal arm 4 is attached at a first end 6 to mounting bracket 8. Mounting bracket 8 is fastened to supporting structure 10, for example, a wall or a pole. Horizontal arm 4 may be permanently attached to mounting bracket 6 or it may be removably attached to allow for easy removal and storage of swing trainer 2 when not in use.

Figure 3:
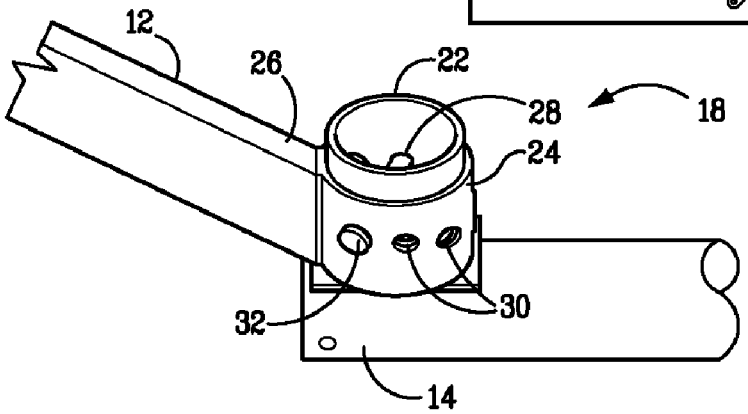
FIG. 3 is an oblique view of the pivotal mounting of the oblique arm to the horizontal arm.

Oblique arm 12 is mounted to horizontal arm 4 at horizontal arm second end 14 at an effective angle to permit gravitational return of vertical arm 16, described in detail below. In a preferred embodiment, angle □, measuring the rise from horizontal of oblique arm 12, is about 3 degrees to about 45 degrees, preferably about 5 degrees to about 30 degrees, and most preferably about 10 degrees. Preferably, oblique arm 12 is pivotally mounted to horizontal arm 4 utilizing pivot assembly 18, illustrated in FIG. 3. Pivotally mounting oblique arm 12 permits vertical arm 16 and, hence, ball 20 to be placed in the most ideal position for a given installation location and/or for a right handed or left handed batter. Additionally, when not being used, oblique arm 12 may be swung completely back, thereby reducing its profile.

Pivot assembly 18 comprises, for example, pivot cylinder 22 fixedly mounted to horizontal arm second end 14 and pivot ring 24 fixedly mounted to oblique arm first end 26. Pivot cylinder orifice 28 is machined into pivot cylinder 22. Pivot ring 24 is sized to seat onto and rotatably engage pivot cylinder 22. A plurality of pivot ring orifices 30 are machined into pivot ring 24 to align with pivot cylinder orifice 28 such that as pivot ring 24 is rotated around pivot cylinder 22, pin 32 may be inserted through pivot ring orifice 30 and pivot cylinder orifice 28 to create a rotational lock of oblique arm 12 at a predetermined location. Optionally, an opposing pivot cylinder orifice 28 allows pin 32 to pass completely through both pivot ring 24 and pivot cylinder 22.

Returning to FIG. 2, stopping member 34 is mounted to oblique arm 12 at a first end 36, preferably so that stopping member 34 is mounted substantially vertically. Optional stopping member backing arm 38 is mounted to oblique arm 12 and positioned to contact stopping member 34 to a predetermined length so as to provide additional support to stopping member 34. Preferably, stopping member 34 is of a cross sectional shape to cradle vertical arm 16 in its start position, for example, "C" or "U" shaped in cross section. Optionally, stopping member 34 may be fixed, for example with at least one screw or bolt (not shown) to stopping member backing arm 38.

Figure 4:
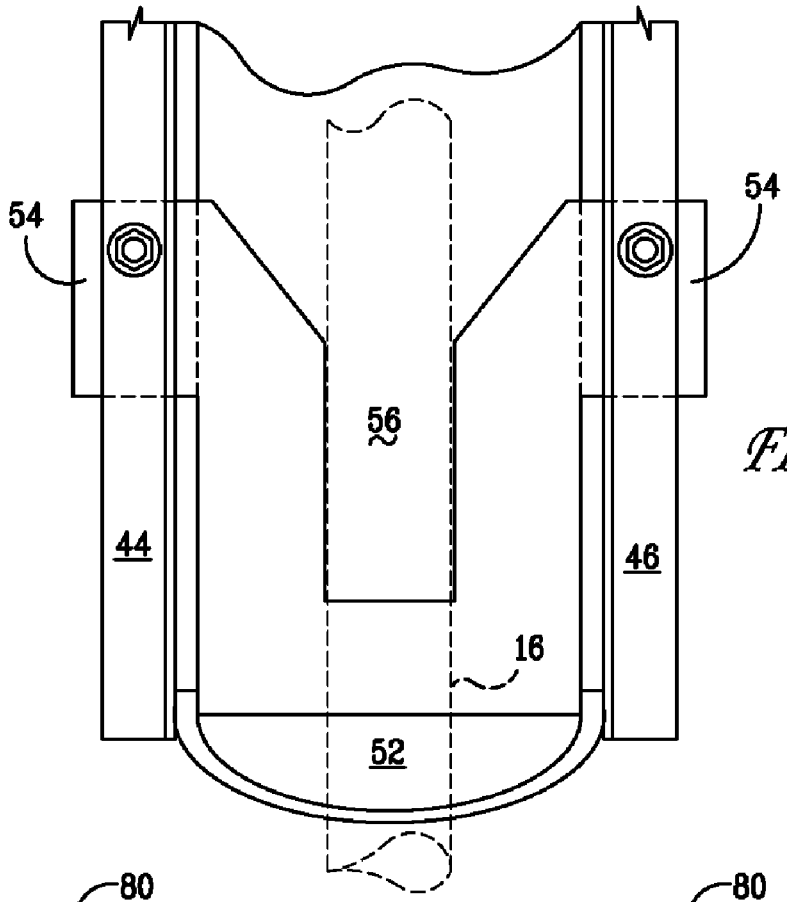
FIG. 4 is a bottom view of the saddle in situ taken at section 4—4 of FIG. 2.

Guide arm support 40 extends from oblique arm 12 to receive a first end 42 of first 44 and second 46 guide arm. Second end 48 of first 44 and second 46 guide arms are attached to stopping member second end 50. Guide arm support 40 is a predetermined length such that when attached, first 44 and second 46 guide arms are positioned to cradle vertical arm 16 throughout its entire length of travel, described in detail below. Saddle 52 (FIG. 4) is attached, for example, with bolts or weld at its wings 54 to first 44 and second 46 guide arms and is shaped so as to direct returning vertical arm 16 into its start position (described in detail below). Saddle cradle area 56 is dimensioned relative to vertical arm 16 such that when vertical arm 16 is fully cradled in its start position it is effectively prevented from moving laterally, i.e. wobbling, thereby creating a "dead stop".

Stopping bar 58 is positioned to stop the forward travel of vertical arm 16, described in detail below. In a preferred embodiment, stopping bar 58 is positioned below first 44 and second 46 guide arm through use of pivotally mounted stopping bar mounting arms 60 and first and second springs 62. Optionally, stopping bar 58 is encased within a sound deadening material 64, for example, rubber, plastic or foam.

Vertical arm 16 is attached at a first end 66 to vertical arm support member 68 which is in turn slidably attached to oblique arm 12. Optionally, at least a portion of vertical arm 16 is covered in sound deadening material 64, for example, rubber, plastic, or foam. Preferably, vertical arm 16 is pivotally attached to vertical arm support member 68.

Figure 5:
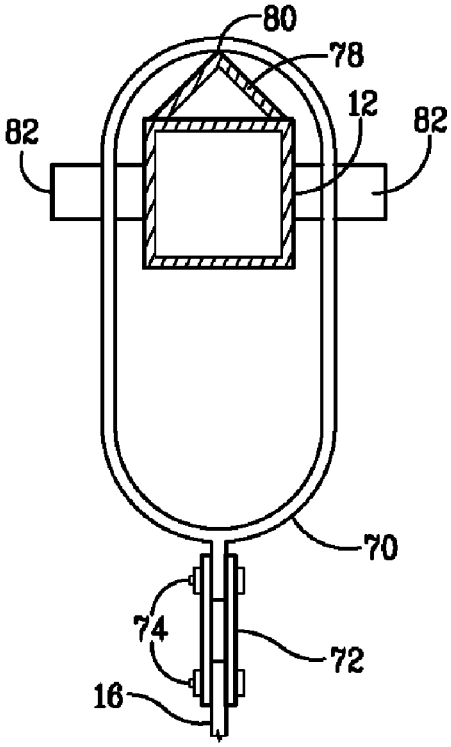
FIG. 5 is a cross sectional view of the sling riding on the sling rod.
Figure 6:
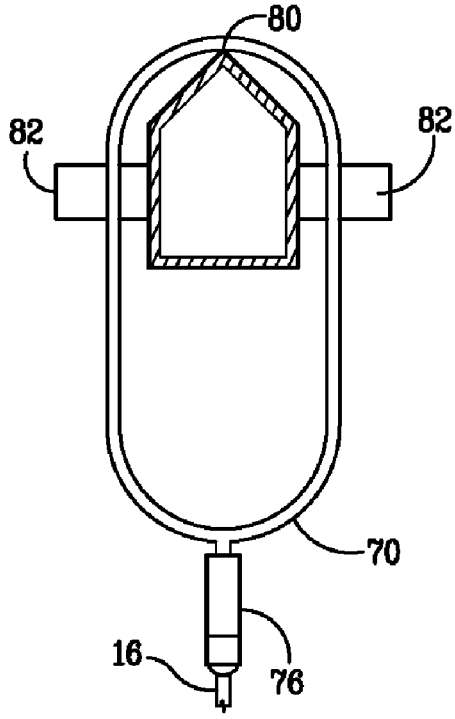
FIG. 6 is a cross sectional view of the sling riding on the apex of an extruded oblique arm.
Figure 7:
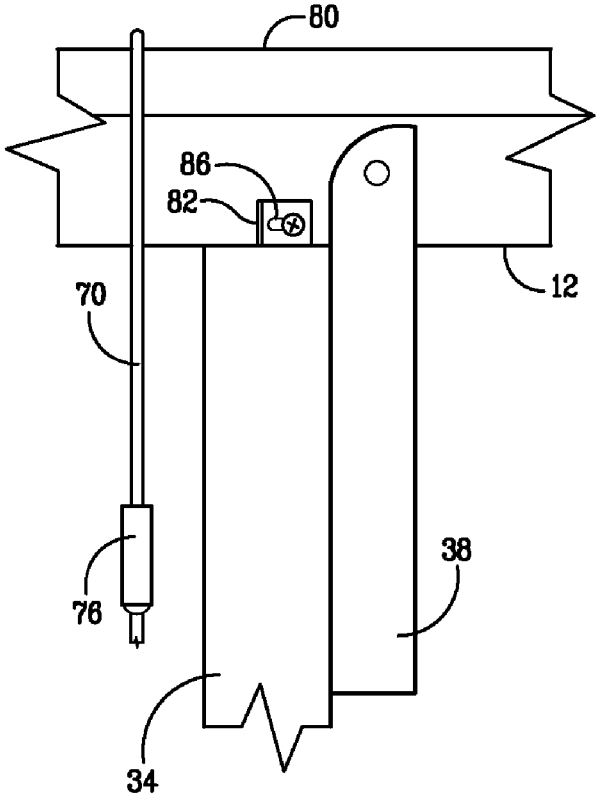
FIG. 7 is a side view illustrating the sling positioning tabs.
Figure 8:
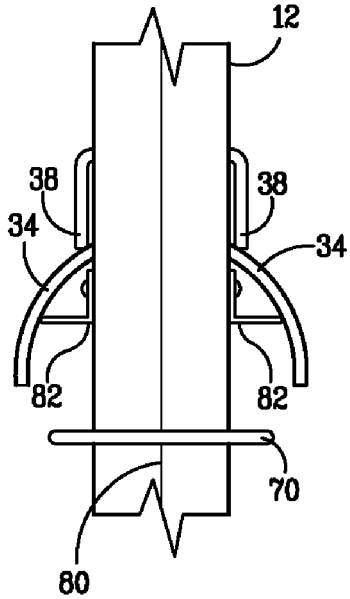
FIG. 8 is a top view illustrating the sling positioning tabs.

In a preferred embodiment, vertical arm support member 68 is pivotally mounted to vertical arm 16 and terminates in sling 70. Turning now to FIGS. 5 to 7, preferably, pivot member 72 is positioned between vertical arm 16 and vertical support member 68, pivotally attached at each end with, for example, pivot pins 74 or, alternatively, with ball joint 76 to achieve a more natural travel path of properly struck ball 20. Optionally, a single pivot point may be used. Oblique arm 12 passes through the open end of sling 70 allowing sling 70 to rest upon oblique arm 12. Optionally, sling rod 78 is mounted to oblique arm 12, for example, by welding, and positioned such that sling rod 78 rests upon oblique arm 12 to produce more efficient sliding. In a preferred embodiment, sling rod 78 has, for example, a triangularly shaped cross section such that sling 70 slides along the apex 80 of the triangle to minimize friction. Optionally, oblique arm 12 may be fabricated, for example, by extrusion, to include an apex 80 for slidably supporting sling 70, thereby eliminating the need for a separate sling rod 78 component.

When sling 70 is used, sling positioning tabs 82 are adjustably mounted to each side of oblique arm 12 and positioned such that when sling 70 returns to its start position, described more fully below, sling 70 is not twisted and pivot member 72 and ball pivot member 84 (FIG. 11), if present, are aligned to pivot in substantially the same vertical plane as oblique arm 12. If pivot member 72 and ball pivot member 84 comprise ball joints, sling positioning tabs 82 may be omitted. In a preferred embodiment, sling positioning tabs 82 comprise, for example, an L shaped bracket fastened, for example, with screws to oblique arm 12 through tab slot 86. Tab slot 86 allows for forward and reverse adjustment of sling positioning tabs 82.

Figure 9:
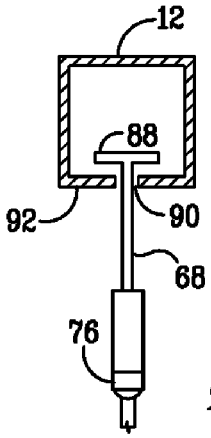
FIGS. 9 and 10 are cross sectional views illustrating optional retentive ends of the vertical support member retained within the oblique arm.
Figure 10:
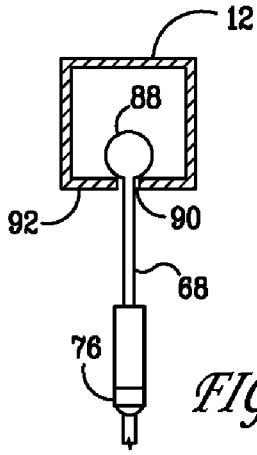

Alternatively, rather than terminating in sling 70, vertical arm support member 68 terminates in retentive end 88, for example, a ball or "T", sized to retentively and slidably fit within groove 90 machined into underside 92 of oblique arm 12 (FIGS. 9 and 10). When retentive end 88 is used, preferably it is used in combination with pivot member 72 and ball pivot member 84 comprising ball joints.

Figure 11:
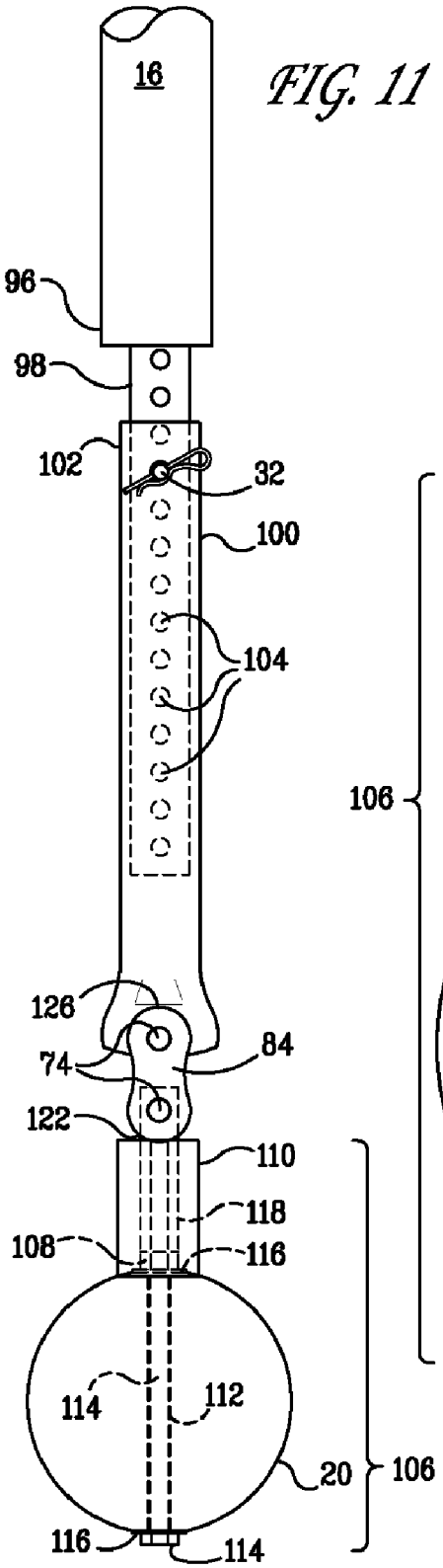
FIG. 11 is a side view illustrating the attachment of the ball to the vertical arm.

Turning to FIG. 11, vertical arm second end 96 terminates in ball attachment assembly retaining member 98. Ball attachment assembly retaining member 98 is connected to ball attachment assembly sleeve 100. Ball attachment assembly sleeve 100 is connected to ball attachment assembly retaining member 98 in a manner that allows for adjustment of the height of ball 20 based upon a batter's height. For example, to achieve this adjustment, in a preferred embodiment, ball attachment assembly sleeve first end 102 slidably overlaps ball attachment assembly retaining member 98. A plurality of ball attachment assembly retaining member orifices 104 are machined into ball attachment assembly retaining member 98 and at least one ball attachment assembly orifice 104 is machined into ball attachment assembly sleeve 100 such that pin 32 may be inserted through ball attachment assembly sleeve 100 into ball attachment assembly retaining member 98 at predetermined locations to establish predetermined distances of ball 20 above the ground, dependant on a batter's height, thereby also permitting easy replacement of ball 20. Optionally, pin 32 passes completely through both ball attachment assembly sleeve 100 and ball attachment assembly retaining member 98.

Preferably, ball attachment assembly sleeve 100 is pivotally attached to ball attachment assembly 106. Although a single pivot point is acceptable, in a preferred embodiment, a more natural travel path of properly struck ball 20 is obtained if ball pivot member 84 is positioned between ball attachment assembly sleeve 100 and ball attachment assembly 106, pivotally attached at each end with, for example, pivot pins 74 or alternatively, with ball joint 76.

Figure 12:
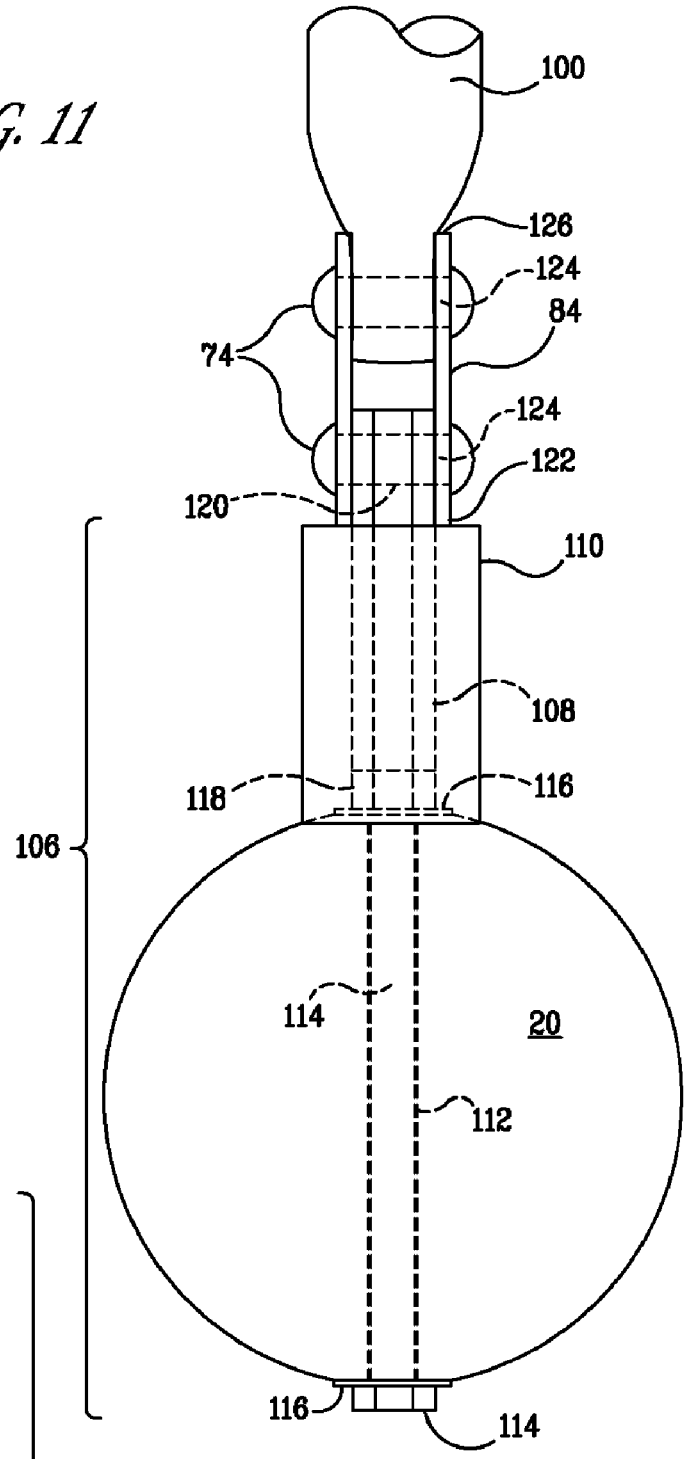
FIG. 12 is a frontal view illustrating the attachment of the ball to the vertical arm.

Turning to FIG. 12, ball attachment assembly 106 comprises ball 20 attached to connector 108. Optional protective sleeve 110, for example, a plastic, rubber or foam sleeve encases at least a portion of connector 108. In a preferred embodiment, ball channel 112 passes through the center of ball 20 and receives ball retaining member, for example, threaded bolt 114. Threaded bolt 114 is sized to an effective diameter to prevent ball wiggle and is sized in length such that an effective amount of thread is exposed to receive washers 116, hex nut 118 and connector 108. In a preferred embodiment, connector 108 is, for example, a threaded elongated hex nut.

Threaded connector 108 is sized to an effective length to allow connector pivot channel 120 to remain patent after connector 108 is threaded onto threaded bolt 114. In a preferred embodiment, ball pivot member 84 is, for example, chain link sized at a first end 122 to overlap threaded connector 108 so as to pivotally receive threaded connector 108 by passing pin 74 through ball pivot member orifices 124 and connector pivot channel 120. Chain link second end 126 is pivotally connected to ball attachment assembly sleeve 100 in like fashion. As stated above, use of ball pivot member 84 causes a properly struck ball 20 to closely mimic the natural flight of a well struck pitched ball.

In use, ball height is adjusted to best fit a batter's height. When ball 20 is struck, ball 20 pivots, moving forward before vertical arm 16, contained within first 44 and second 46 guide arms, slides along oblique arm 12 to engage stopping bar 58. It is this forward movement of ball 20 prior to vertical arm 16 movement which allows the travel path of a properly struck ball 20 to closely mimic the flight path of a well struck pitched ball.

Springs 62 help to dampen the force with which vertical arm 16 strikes stopping bar 58, thereby preventing damage to vertical arm 16 while increasing the rebound force of vertical arm 16 so as to lesson ball 20 return time. Optional sound deadening material 64 on stopping bar 58 and vertical arm 16 helps to reduce noise as vertical arm 16 strikes stopping bar 58 and stopping member 34.

The rebounding force generated coupled with the slant of oblique arm 12 returns vertical arm 16 to its starting position cradled within saddle 52, thereby also returning ball 20 to its starting position. The pivoting attachment of ball 20 causes the travel path of ball 20 when struck with a level swing to mimic the flight path of a well struck pitched ball, thereby providing instantaneous positive feedback.

The present invention also contemplates a method of training a proper swing comprising the steps of adjusting ball 20 to a predetermined swing height; swinging a bat (not shown) to strike ball 20; and watching the travel path of struck ball 20 to gauge swing effectiveness utilizing the swing trainer 2 described above.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A swing trainer comprising:

a ball pivotally attached to a vertical arm;

the vertical arm attached to a vertical arm support member which is slidably attached to an oblique arm having a stopping member at a first end and a stopping bar at a second end positioned to limit the slidable travel of the vertical arm a predetermined amount;

the oblique arm attached at a first end to a second end of a horizontal arm at an effective angle to permit gravitational return of the vertical arm to a start position after the vertical arm slidably traverses the oblique arm; and a mounting bracket attached to a first end of the horizontal arm for mounting the swing trainer to a support structure;

such that when the ball is struck, the ball pivots on the vertical arm as the vertical arm support member slides up the oblique arm, striking the stopping bar and thereafter sliding back down the oblique arm to return to the start position.

2. The swing trainer of claim 1 wherein the mounting bracket is mounted to a pole.

3. The swing trainer of claim 1 wherein the effective angle is about 3 degrees to about 45 degrees.

4. The swing trainer of claim 1 wherein the effective angle is about 10 degrees.

5. The swing trainer of claim 1 wherein the oblique arm is pivotally attached to the horizontal arm.

6. The swing trainer of claim 1 further including a stopping member backing arm mounted to the oblique arm and positioned behind and contacting the stopping member.

7. The swing trainer of claim 1 wherein the stopping member is of a cross sectional shape to cradle the vertical arm in the start position.

8. The swing trainer of claim 1 further including a first and second guide arm, each attached at a first end to a guide arm support first end, the guide arm support attached at its second end to a second end of the oblique arm; each guide arm attached at a second end to the stopping member such that first and second guide arms are positioned to encase the vertical arm throughout its entire length of travel.

9. The swing trainer of claim 8 further comprising a saddle attached to the first and second guide arms positioned to direct the returning vertical arm to the start position and shaped to effectively create a dead stop.

10. The swing trainer of claim 1 wherein the stopping bar is located below the first and second guide arm.

11. The swing trainer of claim 10 wherein the stopping bar is attached to a first end of a pair of mounting arms; the pair of mounting arms pivotally attached at a second end to the first and second guide arm.

12. The swing trainer of claim 11 further comprising a first and second spring elastically attaching each mounting arm to the first and second guide arm, respectively.

13. The swing trainer of claim 1 wherein a second end of the vertical arm support member is pivotally mounted to the vertical arm and a first end of the vertical arm support member forms a sling to encase and rest upon the oblique arm.

14. The swing trainer of claim 13 wherein the vertical arm support member is pivotally mounted to the vertical arm via a pivot member.

15. The swing trainer of claim 14 wherein the pivot member is a pivot selected from the group consisting of a single pivot point, a chain link, and a ball joint.

16. The swing trainer of claim 13 wherein the sling rests upon a sling rod mounted to the oblique arm.

17. The swing trainer of claim 13 further including a pair of sling positioning tabs mounted to each side of the oblique arm, positioned such that when vertical arm is in the start position, the sling contacts the pair of sling positioning tabs, the sling is not twisted, and the ball pivots in a plane substantially containing the oblique arm.

18. The swing trainer of claim 1 wherein a second end of the vertical arm support member is pivotally mounted to the vertical arm and a first end of the vertical arm support member forms a retentive end effectively sized to retentively and slidably fit within a groove fabricated into an underside of the oblique arm.

19. The swing trainer of claim 1 wherein vertical arm includes a vertical arm second end terminating in a ball attachment assembly retaining member, the ball attachment assembly retaining member adjustably connected to a ball attachment assembly sleeve, the ball attachment assembly sleeve pivotally attached to a ball attachment assembly.

20. The swing trainer of claim 19 wherein the ball attachment assembly sleeve is pivotally attached to the ball attachment assembly via a pivot member.

21. The swing trainer of claim 20 wherein the pivot member is a pivot selected from the group consisting of a single pivot point, a chain link, and a ball joint.

22. The swing trainer of claim 19 wherein the ball attachment assembly comprises the ball attached to a connector for pivotal attachment.

23. A swing trainer comprising:

a ball pivotally attached to a vertical arm;

the vertical arm attached to a vertical arm support member which is slidably attached to an oblique arm having a stopping member at a first end and a stopping bar at a second end positioned to limit the slidable travel of the vertical arm a predetermined amount;

a stopping member backing arm mounted to the oblique arm and positioned behind and contacting the stopping member;

a first and second guide arm, each attached at a first end to a guide arm support first end, the guide arm support attached at its second end to a second end of the oblique arm; each guide arm attached at a second end to the stopping member such that first and second guide arms are positioned to encase the vertical arm throughout its entire length of travel;

a saddle attached to the first and second guide arms positioned to direct the returning vertical arm to a start position and shaped to effectively create a dead stop;

the oblique arm pivotally attached at a first end to a second end of a horizontal arm at an effective angle to permit gravitational return of the vertical arm to the start position after the vertical arm slidably traverses the oblique arm; and a mounting bracket attached to a first end of the horizontal arm for mounting the swing trainer to a support structure;

the stopping bar attached to a first end of a pair of mounting arms; the pair of mounting arms pivotally attached at a second end to the first and second guide arm;

a first and second spring elastically attaching each mounting arm to the first and second guide arm, respectively;

such that when the ball is struck, the ball pivots on the vertical arm as the vertical arm support member slides up the oblique arm, striking the stopping bar and thereafter sliding back down the oblique arm to return to the start position.

24. A method for training a swing comprising the steps of:

adjusting a ball to a predetermined swing height;

swinging a bat to strike the ball; and watching a travel path of the struck ball to gauge swing effectiveness, wherein the ball is pivotally attached to a vertical arm;

the vertical arm is attached to a vertical arm support member which is slidably attached to an oblique arm having a stopping member at a first end and a stopping bar at a second end positioned to limit the slidable travel of the vertical arm a predetermined amount;

the oblique arm is attached at a first end to a second end of a horizontal arm at an effective angle to permit gravitational return of the vertical arm to a start position after the vertical arm slidably traverses the oblique arm; and a mounting bracket is attached to a first end of the horizontal arm for mounting the swing trainer to a support structure;

such that when the ball is struck, the ball pivots on the vertical arm as the vertical arm support member slides up the oblique arm, striking the stopping bar and thereafter sliding back down the oblique arm to return to the start position.

* * * * *